US007509756B2

(12) United States Patent
Lebo

(10) Patent No.: US 7,509,756 B2
(45) Date of Patent: Mar. 31, 2009

(54) BRACE FOR A SHOE

(75) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 581 days.

(21) Appl. No.: 11/155,344

(22) Filed: Jun. 17, 2005

(65) Prior Publication Data

US 2006/0283048 A1 Dec. 21, 2006

(51) Int. Cl.
*A43B 23/00* (2006.01)
*A43B 7/20* (2006.01)

(52) U.S. Cl. ..... 36/89; 36/58; 36/88; 36/132

(58) Field of Classification Search ..... 36/89, 36/58, 50.1, 58.5, 72 B, 96, 102
See application file for complete search history.

(56) References Cited

U.S. PATENT DOCUMENTS 1,155,506 A * 10/1915 Osaki ..... 36/72 R
2,147,197 A * 2/1939 Glidden ..... 36/9 R
2,972,822 A * 2/1961 Tanner ..... 36/89
4,670,998 A 6/1987 Pasternak ..... 36/114
4,766,681 A 8/1988 O'Rourke et al. ..... 36/89
4,989,350 A 2/1991 Bunch et al. ..... 36/89
5,152,082 A 10/1992 Culpepper ..... 36/89
5,175,947 A * 1/1993 Parracho ..... 36/89
5,243,772 A 9/1993 Francis et al. ..... 36/114
5,408,761 A 4/1995 Gazzano ..... 36/88
5,430,960 A 7/1995 Richardson ..... 36/89
5,692,319 A * 12/1997 Parker et al. ..... 36/50.1
5,896,683 A 4/1999 Foxen et al. ..... 36/89
6,170,175 B1 1/2001 Funk ..... 36/89

* cited by examiner

*Primary Examiner*—Jila M Mohandesi
(74) *Attorney, Agent, or Firm*—St. Onge Steward Johnston & Reens LLC

(57) ABSTRACT

The invention relates to a shoe having an outsole, an upper having a notch, a brace having at least one localized area placed in the notch, and the brace being in contact with and secured to both the upper and the outsole. The invention also relates to a method for providing the shoe.

21 Claims, 5 Drawing Sheets

BRACE FOR A SHOE

FIELD OF THE INVENTION

The invention relates to footwear having improved support.

BACKGROUND OF THE INVENTION

Footwear for various activities, such as skiing, hiking, skating, or construction, often have features not commonly found in other footwear. Such features may include rigidity to provide support and protection for the foot or a brace to further enhance support to inhibit injury and/or to promote proper form. However, these types of rigid footwear are typically uncomfortable irregardless of any cushioning or removable inserts that may be employed within such footwear.

Other activities, such as walking or running, normally use footwear having a high degree of flexibility and cushion so that the footwear may absorb shock. However, these types of footwear typically lack proper support because a cushioned product usually lacks structural integrity due to its inherent softness. Therefore, safety or performance may be compromised.

Flexible shoes that employ the use of a brace were possibly developed to achieve the advantages of both a rigid shoe and a cushioned shoe. However, they may be bulky and cumbersome due to the thickness of a brace being added to the shoe wall. Further, the brace may separate from the shoe, in which case it may catch upon foreign objects and present a safety hazard. In the event the shoe is used for hiking, the brace may catch against or present a pocket for rocks and debris. In the event the shoe is used for sports, other players' feet may catch the dislodged brace.

U.S. Pat. No. 5,896,683 to Foxen, U.S. Pat. No. 4,670,998 to Pasternak, U.S. Pat. No. 4,989,350 to Bunch, U.S. Pat. No. 5,243,772 to Francis, U.S. Pat. No. 5,152,082 to Culpepper, U.S. Pat. No. 5,408,761 to Gazzano, and U.S. Pat. No. 4,766,681 to O'Rourke all seem to relate to a brace on an outside of the shoe. Although some of these inventions sew a brace on an outside of a shoe, the inventions do not address the bulkiness problem.

U.S. Pat. No. 6,170,175 to Funk and U.S. Pat. No. 5,430,960 to Richardson appear to show braces located on an inside of the shoe. However, these do not typically address the bulkiness problems mentioned above.

What is desired, therefore, is a shoe having improved support without sacrificing comfort, and vice versa. Another desire is a shoe with is a shoe with a securely attached brace. A further desire is a shoe with a brace that has reduced bulk. Yet another desire is to provide a shoe with a brace wherein the overall weight and thickness of the shoe is reduced without sacrificing performance or comfort.

SUMMARY OF THE INVENTION

It is therefore an object of the invention to provide a shoe that has support without sacrificing comfort and/or flexibility.

Another object is to provide a shoe having a brace securely attached to the shoe.

A further desire is to provide a shoe with reduced bulk without sacrificing performance or support.

These and other objects of the invention are achieved by a shoe having an outsole, an upper having a notch, a brace having at least one localized area placed in the notch, and the brace being in contact with and secured to both the upper and the outsole.

In some embodiments, the brace is secured to the notch. In other embodiments, the brace has at least a second localized area outside of the notch.

To provide support in select areas of the shoe that may be subjected to increased stress, the brace has a thickness that varies along a length of the brace, where the brace is thicker in a first area than in a second area. For example, the first area is an ankle and the second area is a heel or shin.

In some embodiments, a securing mechanism is used to secure the brace to the upper and outsole, where the securing mechanism is a shoelace. In some of these embodiments, the brace further includes an aperture for permitting the shoelace to pass through.

Optionally, to enhance forward flexibility, the upper has a fore section removed in a fore area of the upper. Likewise, the upper may have a rear section removed in a rear area of the upper to enhance rearward flexibility.

In another aspect of the invention, a method for providing a shoe is provided. The method includes the steps of providing an outsole and an upper, providing a notch in a side of the upper, placing a part of a brace in the notch, and securing the brace to both the upper and the outsole.

The method may also include the step of securing the brace to the notch or placing a second part of the brace outside of the notch.

To enhance support to areas of the shoe that may be subjected to increased stress, the method may include varying a thickness of the brace along a length of the brace, such as thickening the brace in a first area and thinning the brace in a second area.

In some embodiments, the method includes the step of securing the upper and outsole with a securing mechanism. Optionally, to enhance forward flexibility, the method includes removing a fore section in a fore area of the upper. Likewise, the method may include removing a rear a rear section in a rear area of the upper to enhance rearward flexibility.

DETAILED DESCRIPTION OF THE DRAWINGS

Figure 1:
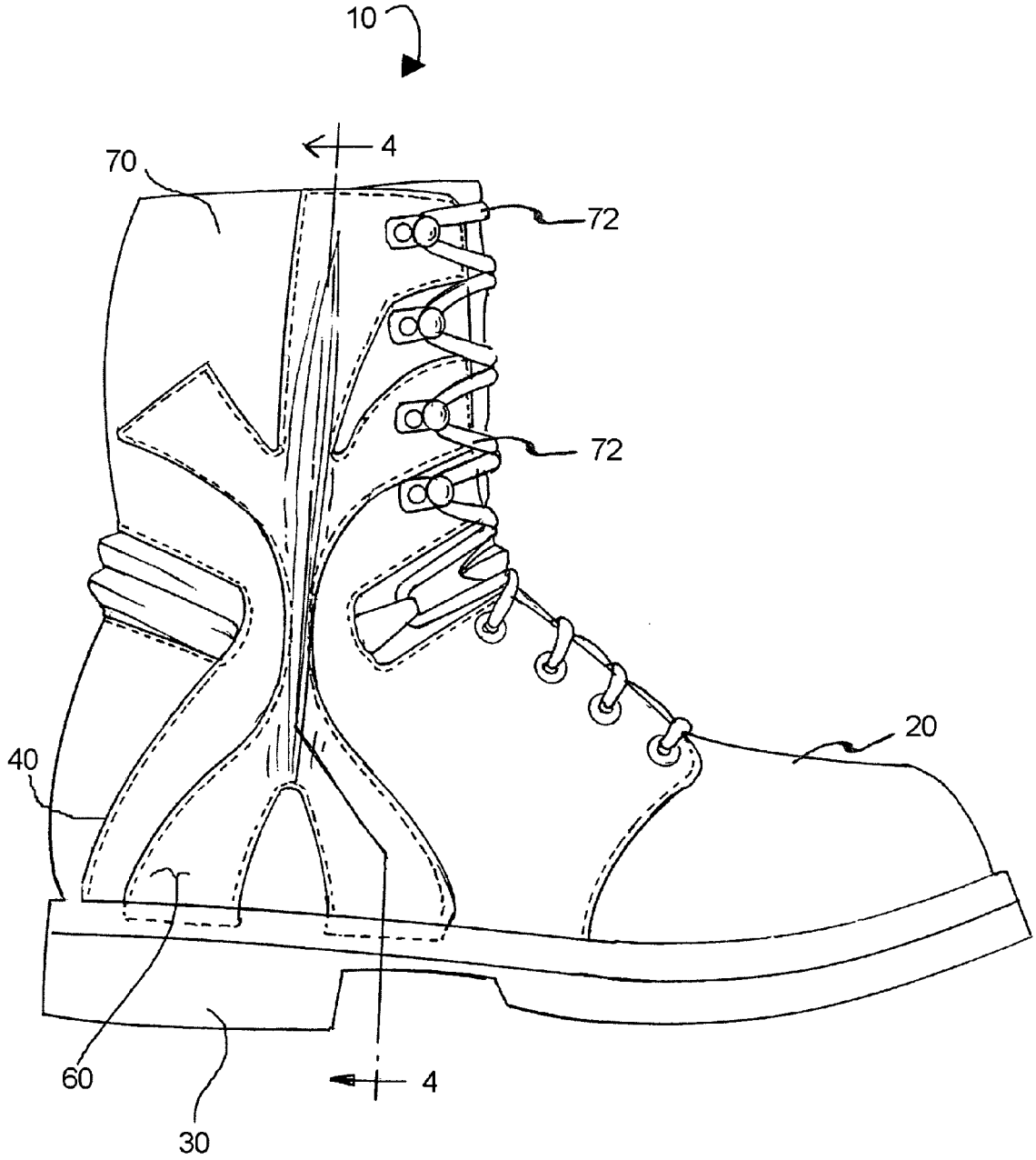
FIG. 1 depicts the shoe in accordance with the invention.

FIG. 1 depicts shoe 10 in accordance with the invention. Shoe 10 includes upper 20, outsole 30, notch 40 in upper, and brace 60 for providing support to a user.

Figure 2:
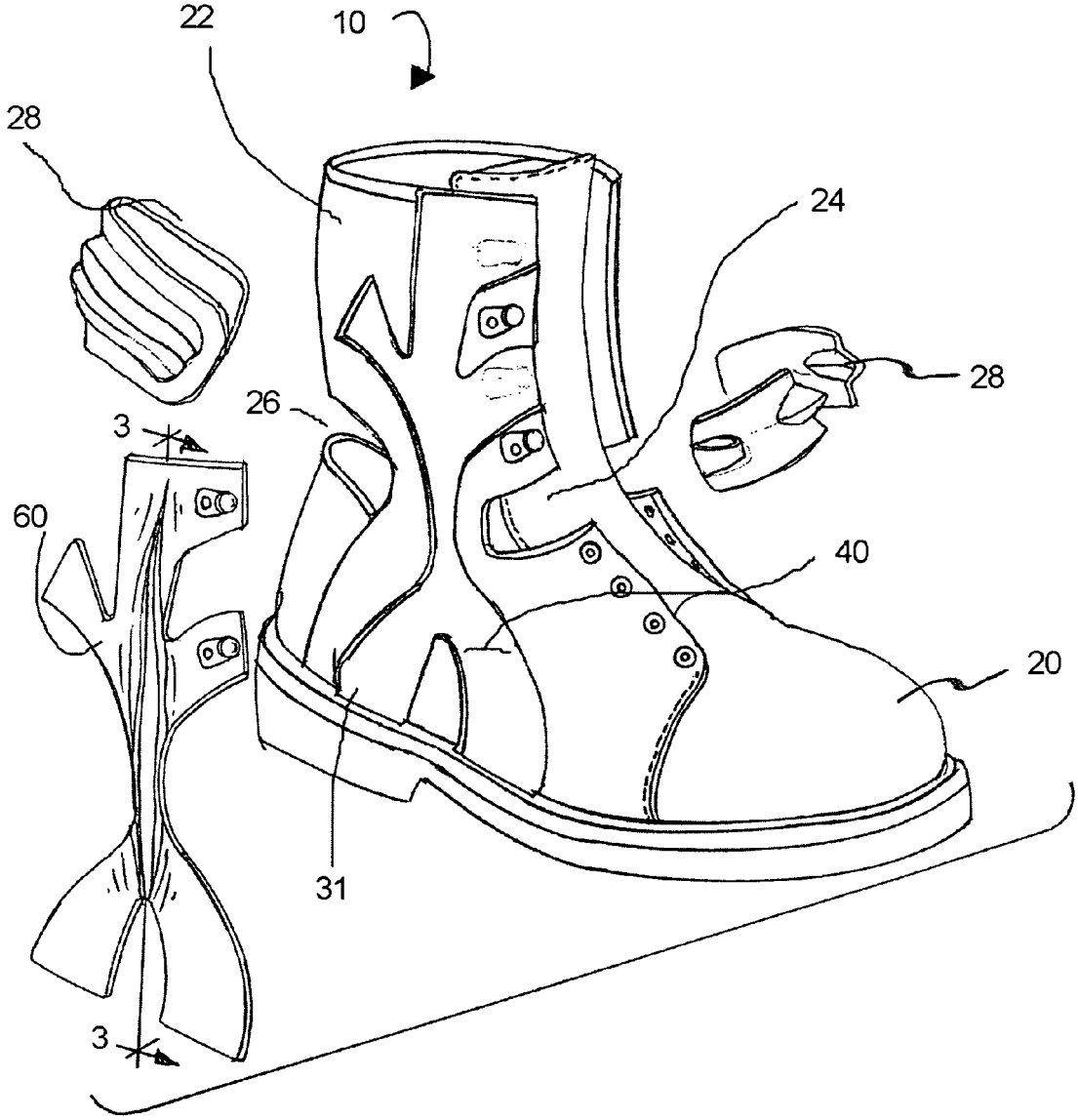
FIG. 2 depicts an assembly view of the shoe shown in FIG. 1.
Figure 4:
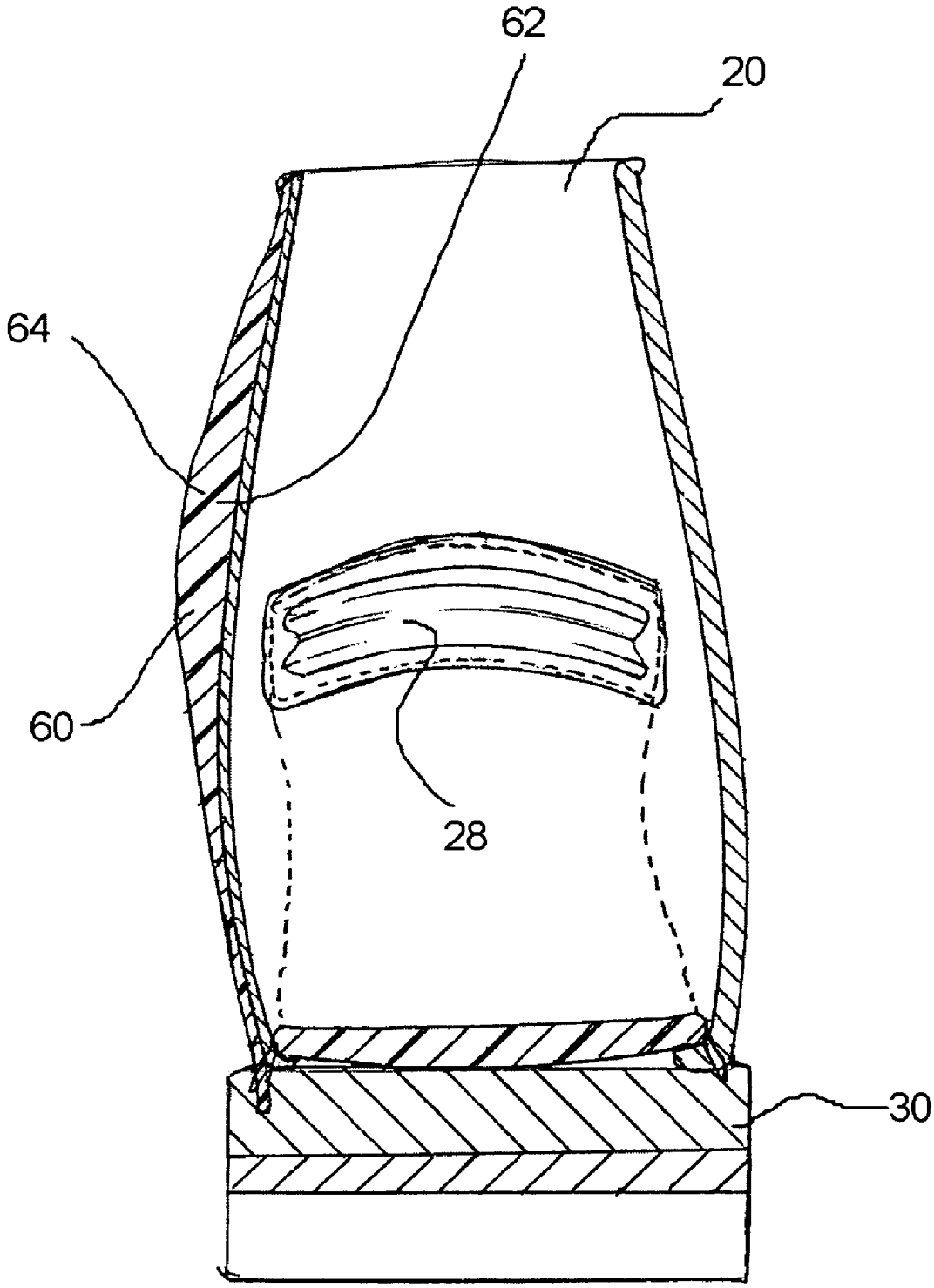
FIG. 4 depicts a cross sectional view of the shoe shown in FIG. 1.

Notch 40 is more clearly depicted in FIG. 2. As shown, notch 40 is in side 22 of upper 20 and where brace 60 is placed within notch 40. It is not necessary for the entire brace 60 to be placed within notch 40. As shown in FIG. 4, at least one localized area 62 of brace 60 is within notch 40 and at least a second localized area 64 of brace 60 is outside of notch 40.

Notch 40 includes an indentation, channel, groove, or etching in upper 20 and may be formed or manufactured using any known or novel methods or equipment, such as machining, grinding, etching, laser cutting, cutting, or the like.

Figure 3:
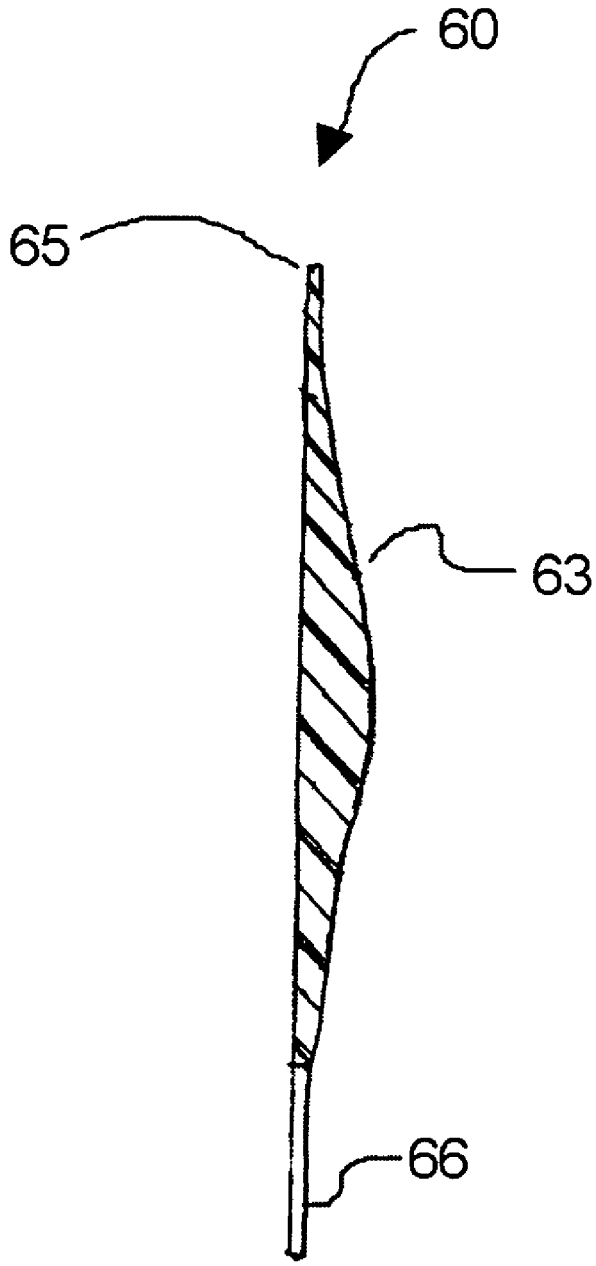
FIG. 3 depicts a cross sectional view of the brace shown in FIG. 1.

Brace 60 is any rigid material suitable for providing support to a user's leg, such as thermal polyurethane, thermoplastic, plastic, rubber, and the like. As shown in FIG. 3, brace 60 has a varying thickness along a length of brace 60. Varying a thickness of brace 60 permits brace 60 to provide enhanced support in select areas of shoe 10, such as ankle area 63. Brace 40 is thinner in other select areas of shoe 10, such as the shin 65 or outsole 66 areas.

Brace 60 provides lateral support to shoe 10 to reduce twisting of the user's ankle while providing flexibility in the forward and rearward motion, resulting in less resistance while the user's walks or runs but still maintaining resistance in the left or right direction.

Brace 60 is secured to both upper 20 and outsole 30 with securing mechanism 70, which may be a stitch, wire, leather, fastener, rivet, adhesive, or any other structure used to attach brace 60 to upper 20 and outsole 30. In a further embodiment, securing mechanism 70 secures brace 60 within notch in addition to upper 20 and outsole 30.

Still further, brace 60 may include aperture 68 to permit securing mechanism 70 to pass through. As shown in FIG. 1, shoelace 72 acts as securing mechanism 70 in addition to tying shoe 10 to the user's foot.

In addition, outsole 30 may optionally include clearance 31 for providing an area into which brace 60 is placed. By providing clearance 31, brace 60 is more adequately secured since brace 60 is not held in place by outsole 30 in addition to or instead of the above described securing mechanism 70 or shoelace 72.

In some embodiments, to further enhance flexibility in the forward and rearward direction, fore 24 section and rear 26 sections of upper 20 may be removed. Optionally, the upper material of fore 24 and/or rear 26 sections that are removed may be replaced with soft material 28, or material having less stiffness and less resistance to bending than fore 24 and rear 26 materials. Soft material 28 includes leather, rubber, foam, vinyl, visco elastic foam, and the like.

Figure 5:
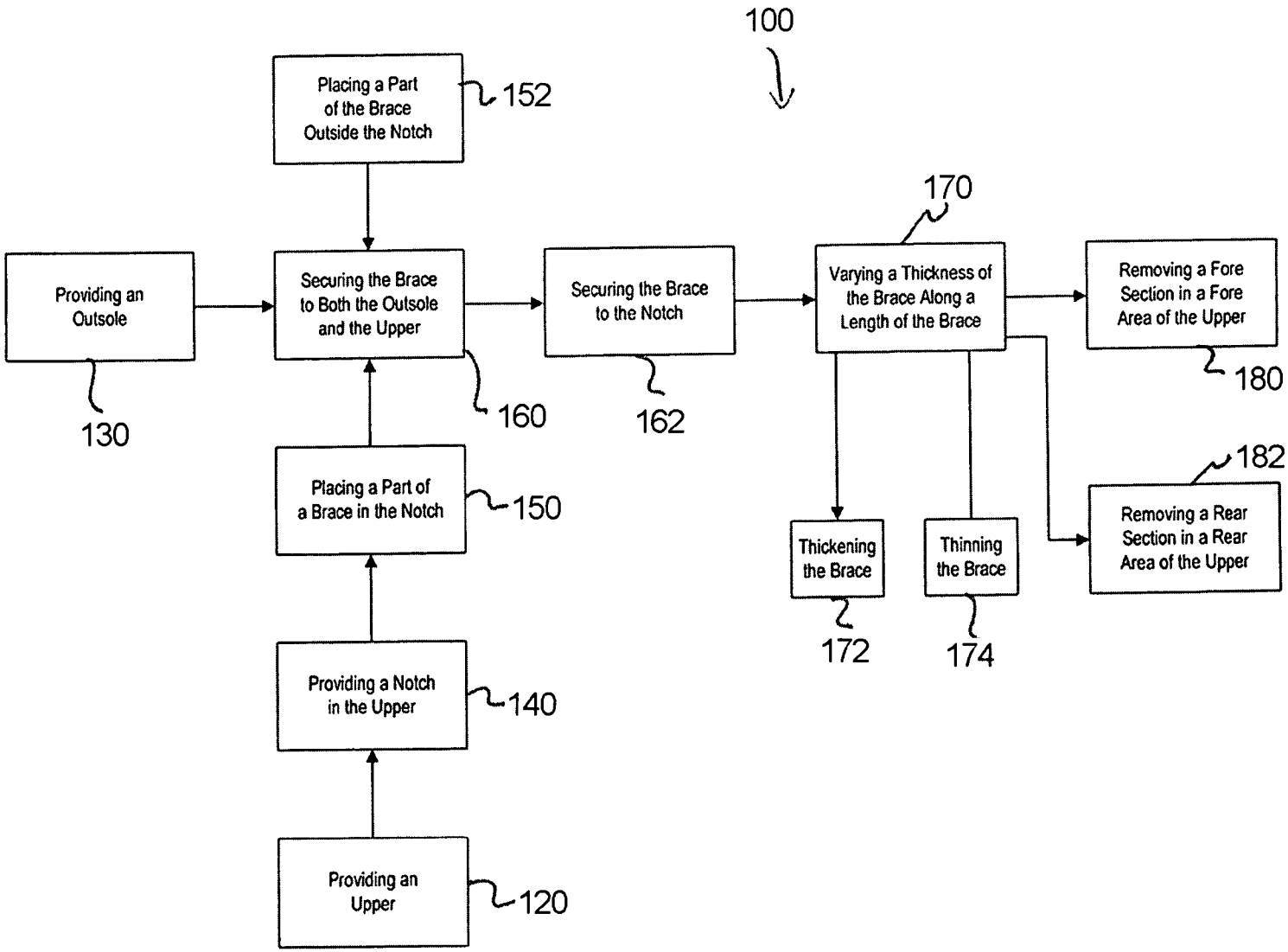
FIG. 5 depicts a method for providing the shoe shown in FIG. 1.

FIG. 5 depicts another aspect of the invention, method 100 for providing shoe 10 includes the steps of providing 120 an upper, providing 130 an outsole, and providing 140 a notch in a side of the upper. Additionally, method 100 includes placing 150 a part of a brace in the notch and securing 160 the brace to both the upper and the outsole with a securing mechanism. Optionally, method 100 may place 152 a part of the brace outside of the notch.

In some embodiments, method 100 may include securing 162 the brace to the notch. In further embodiments, method 100 includes varying 170 a thickness of the brace along a length of the brace, wherein method 100 includes thickening 172 the brace in a first area and thinning 174 the brace in a second area.

Optionally, method 100 may include removing 180 a fore section in a fore area of the upper to enhance forward flexibility and/or removing 182 a rear section in a rear area of the upper to enhance rearward flexibility.

What is claimed is:

1. A shoe, comprising:

an outsole;

an upper having a notch;

a brace having a periphery, at least a first part of said brace being disposed in said notch;

wherein said brace is in direct contact with and secured to both said upper and said outsole; and wherein the thickness of said brace near said periphery of at least said first part is substantially the same as a depth of said notch, such that an outer surface of said brace and an outer surface of said upper form a substantially continuous surface near said periphery.

2. The shoe according to claim 1, wherein said brace is secured to said notch by one of the group consisting of stitching, adhesive, and rivets.

3. The shoe according to claim 1, wherein said brace has at least a second part outside of said notch.

4. The shoe according to claim 1, wherein said brace has a thickness that varies along a length of said brace.

5. The shoe according to claim 4, wherein said brace is thicker in a first area than in a second area.

6. The shoe according to claim 5, wherein said first area is an ankle.

7. The shoe according to claim 5, wherein said second area is a heel.

8. The shoe according to claim 5, wherein said second area is a shin.

9. The shoe according to claim 1, further comprising a securing mechanism for securing said brace to said upper and said outsole.

10. The shoe according to claim 9, wherein said securing mechanism is a shoelace.

11. The shoe according to claim 10, wherein said brace further comprises an aperture for permitting said shoelace to pass through.

12. The shoe according to claim 1, wherein said upper has a fore section removed in a fore area of said upper to enhance forward flexibility.

13. The shoe according to claim 1, wherein said upper has a rear section removed in a rear area of said upper to enhance rearward flexibility.

14. A method for providing a shoe, comprising the steps of:

providing an outsole and an upper;

providing a notch in a side of the upper having a depth;

providing a brace having a periphery in a first part of said brace with a thickness that is substantially the same as the depth of said notch;

placing the first part of the brace in the notch such that an outer surface of the brace and an outer surface of the upper form a substantially continuous surface near said periphery;

securing the brace directly to the upper; and securing the brace directly to the outsole.

15. The method according to claim 14, further comprising the step of securing the brace to the notch.

16. The method according to claim 14, further comprising the step of placing a second part of the brace outside of the notch.

17. The method according to claim 14, further comprising the step of varying a thickness of the brace along a length of the brace.

18. The method according to claim 14, further comprising the step of thickening the brace in a first area and thinning the brace in a second area.

19. The method according to claim 14, further comprising the step of securing the upper and outsole with a securing mechanism.

20. The method according to claim 14, further comprising the step of removing a fore section in a fore area of the upper to enhance forward flexibility.

21. The method according to claim 14, further comprising the step of removing a rear section in a rear area of the upper to enhance rearward flexibility.

* * * * *